United States Patent [19]

Bohnenkamp et al.

[11] Patent Number: 4,848,128

[45] Date of Patent: Jul. 18, 1989

[54] ROLL STAND WITH AXIALLY OPPOSITELY SHIFTABLE WORKING ROLLS

[75] Inventors: Heinrich Bohnenkamp, Neuss; Friedel Mogendorf, Duisburg, both of Fed. Rep. of Germany

[73] Assignee: SMS-Schloemann-Siemag Aktiengesellschaft, Dusseldorf, Fed. Rep. of Germany

[21] Appl. No.: 209,277

[22] Filed: Jun. 17, 1988

Related U.S. Application Data

[63] Continuation-in-part of Ser. No. 11,979, Feb. 6, 1987, abandoned.

[30] Foreign Application Priority Data

Feb. 6, 1986 [DE] Fed. Rep. of Germany ..... 3603693

[51] Int. Cl.[4] ..... B21B 31/18; B21B 31/10

[52] U.S. Cl. ..... 72/247; 72/238; 72/243

[58] Field of Search ..... 72/247, 245, 243, 241, 72/237, 238, 239

[56] References Cited

U.S. PATENT DOCUMENTS 2,047,883 7/1936 Phillips ..... 72/243
2,279,415 4/1942 Simons ..... 72/247 X

FOREIGN PATENT DOCUMENTS 2260256 6/1973 Fed. Rep. of Germany .
0073409 6/1980 Japan ..... 72/247
0163516 9/1983 Japan ..... 72/247
0240652 4/1969 U.S.S.R. ..... 72/247

*Primary Examiner*—Robert L. Spruill
*Assistant Examiner*—Steven B. Katz
*Attorney, Agent, or Firm*—Herbert Dubno

[57] ABSTRACT

A roll stand has a stationary frame having a drive side and a service side, upper and lower working rolls having axially opposite ends at the sides, respective pairs of upper and lower journal blocks coupled with the ends of the rolls at the sides and a drive connected to the working-roll ends at the drive side for oppositely rotating the working rolls. Respective upper and lower pusher bodies are provided adjacent the journal blocks in the frame and respective upper and lower guides in the frame support the bodies for displacement of same only axially in the frame. Respective pairs of formations at least one of which is vertically elongated couple each of the bodies to the respective block for joint axial displacement while permitting relative vertical nonaxial displacement between the bodies and the respective blocks. One of the pusher bodies can be pushed axially with the respective journal block and roll in the frame and racks are formed on the pusher bodies in mesh with a service-side gear that is supported on the frame for rotation on the service side about a stationary axis perpendicular to the racks and nonmovable on the frame so that axial displacement of one of rolls with the respective rack rotates the gear and axially oppositely displaces the other working roll regardless of the relative vertical positions of the rolls.

13 Claims, 5 Drawing Sheets

ROLL STAND WITH AXIALLY OPPOSITELY SHIFTABLE WORKING ROLLS

CROSS REFERENCE TO RELATED APPLICATION

This application is a continuation-in-part of my copending application No. 011,979 filed Feb. 06, 1987, now abandoned.

FIELD OF THE INVENTION

The present invention relates to a roll stand for rolling strip material. More particularly this invention concerns an apparatus for axially oppositely shifting the working rolls of such a piece of equipment.

BACKGROUND OF THE INVENTION

A standard four-high rolling stand of the type used for rolling strip steel and described in German patent document No. 3,331,055 has a pair of vertically spaced nip-defining working rolls of relatively small diameter and typically of bottle shape. Respective upper and lower backup rolls of larger diameter bear respectively down and up toward the nip on the respective working rolls. Thus the bendability of the small-diameter working rolls is largely canceled out by the rigidity of the larger-diameter backup rolls so that the large forces required for rolling can be brought to bear on the workpiece.

To minimize roll bending and thereby improve the uniformity of workpiece thickness while also minimizing wear to the working rolls, it is known to make these working rolls axially shiftable. Thus as described in U.S. Pat. No. 4,669,296 it is known for the roll stand to have working-roll journal blocks which can be axially shifted in the frame with the respective working rolls, and to be able to bend the working rolls positively and negatively, that is respectively convex and concave toward the workpiece, a system also seen in U.S. Pat. No. 3,857,268. A pair of large-diameter and substantially parallel backup rolls flank and bear toward the nip on the working rolls. Respective journal blocks support the backup rolls in the frame for rotation about substantially parallel axes flanking and generally coplanar with the working-roll axes. A strip is passed repeatedly in a multipass run through the nip generally perpendicular to the plane while the working rolls are pressed against the workpiece to reduce its thickness. The working rolls are axially displaced relative to the workpiece a plurality of times during the run to change the region of contact between the workpiece edges and the working rolls during the run. The working rolls are also bent at least to maintain the workpiece thickness downstream of the nip generally uniform.

In such systems it is standard to simply provide a large double-acting hydraulic ram for each working roll. Since the workpiece is invariably centered in the rolling line, it therefore is necessary to move the two working rolls axially oppositely, so as either to decrease or increase the region of axial overlap while keeping the center of this overlap region in the same axial position. Such equipment is fairly complicated and bulky. It requires some monitoring to ensure that the axial opposite motion is indeed perfectly opposite and complementary, and when benders which cannot move relative to the respective rolls are provided the complexity is even increased.

Another problem is created in the systems where the working rolls are replaceable. In these arrangements the journal blocks of the working rolls are connected via appropriate formations such as described in German patent document No. 3,331,055 to pushers which are in turn connected to the respective axial-shifting actuators. This makes it fairly easy to disconnect a subassembly comprised of a working roll and its journal blocks from its respective pushers and replace it with a freshly ground one by releasing the journal blocks from the respective pushers and pulling them with the respective working rolls axially out of the service side of the stand. Nonetheless the provision of big individual actuators for the working rolls substantially complicated such exchange of working rolls.

OBJECTS OF THE INVENTION

It is therefore an object of the present invention to provide an improved roll stand with removable and axially oppositely shiftable working rolls.

Another object is the provision of such a roll stand with removable and axially oppositely shiftable working rolls which overcomes the above-given disadvantages, that is which has a simple apparatus for complementarily oppositely shifting these rolls, one which takes up little space, which is simple to operate, and which always guarantees perfectly complementary and opposite movement of the working rolls.

SUMMARY OF THE INVENTION

A roll stand according to this invention has a stationary frame having a drive side and a service side, upper and lower working rolls having axially opposite ends at the sides, respective pairs of upper and lower journal blocks coupled with the ends of the rolls at the sides for rotation in the frame about respective parallel upper and lower axes and a drive connected to the working-roll ends at the drive side for oppositely rotating the working rolls about their respective axes. Respective upper and lower pusher bodies are provided adjacent the journal blocks in the frame and respective upper and lower guides in the frame support the bodies for displacement of same only axially in the frame. Respective pairs of formations at least one of which is vertically elongated couple each of the bodies to the respective block for joint axial displacement while permitting relative vertical nonaxial displacement between the bodies and the respective blocks. One of the pusher bodies is directly engaged so it can be pushed axially with the respective journal block and roll in the frame and respective substantially identical, axially extending, and confronting racks are formed on the upper pusher body of the service side and on the respective lower pusher body and are both in mesh with a service-side gear that is supported on the frame for rotation on the service side about a stationary axis perpendicular to the racks and nonmovable on the frame so that axial displacement of one of rolls with the respective rack rotates the gear and axially oppositely displaces the other working roll regardless of the relative vertical positions of the rolls.

Such a simple system accurately positions the two working rolls without moving the location of the center of the region of overlap. Only a single double-acting actuator or two single-acting ones are needed. In addition only a single device need be provided to monitor the positioning of both of the rolls, so the overall simplification achieved by the system of this invention is considerable.

The axial shifter can be a reversible drive motor connected directly to the one gear. In addition the system of this invention has benders braced against the journal blocks for bending the working rolls. In this case the stand also has respective axially extending and confronting drive-side racks formed on at least one of the upper pusher bodies of the drive side and on the respective lower pusher body, and a gear meshing with both of the drive-side racks and supported on the frame for rotation on the drive side about a stationary axis perpendicular to the drive-side racks.

For synchronous movement in this case a link is provided between the service- and drive-side pusher blocks for jointly and synchronously axially displacing same. This link can be a rigid axially extending link extending between a one of the service-side pusher bodies and the corresponding drive-side pusher body. It is also possible for the link to include a coupling shaft connected between the service- and drive-side gears for jointly and synchronously rotating same. There can be service- and drive-side gear shafts carrying the respective gears and provided with respective arms projecting generally parallel to each other from the gear shafts and interconnected by the coupling shaft like a parallelogrammatic linkage. Alternately bevel gears mounted on the gear shafts mesh with bevel gears carried on the coupling shaft.

The formations according to this invention are a nonaxially projecting abutment on each pusher body and a vertically extending groove on the respective journal block receiving the respective abutment. With the actuator on the service side, the abutment formation of each drive-side journal block will lie between the respective pusher-body abutment so that whichever working roll. Thus if, for example, the lower working roll is pushed toward the drive side and the upper roll is pulled oppositely by actuators on the service side, the drive-side journal-block abutment formation of the lower working roll will engage the respective pusher body and push it axially outward while in theory the abutment of the upper journal block on the drive side will pull away from the respective upper pusher-body abutment. Since, however, each pusher body on the drive side is connected via the synchronizing gear to the other drive-side pusher body, these gears will cause the upper pusher bodies to move with their abutments inward, following the respective upper journal block which can otherwise move axially in it.

The axial shifter of this invention can be respective upper and lower single-acting actuators connected to the upper and lower pusher bodies. In addition the guides are open toward the journal blocks and provided with covers, the pusher bodies have outwardly open recesses, and the journal blocks are provided with projections engaging through the guides to the covers.

Typically the pusher body of each journal block in fact has two separate parts flanking the respective journal block. Both of these parts are axially shiftable in the respective side of the stand. Synchronization is achieved by providing one such rack formation on each pusher-body part and a respective synchronizing gear journaled on the frame and meshing with it and with the underlying or overlying other pusher-body part. The two gears of each upper or lower pusher body are interconnected by a shaft extending parallel to the workpiece travel direction through the nip of the stand of this invention.

DESCRIPTION OF THE DRAWING

The above and other features and advantages will become more readily apparent from the following, reference being made to the accompanying drawing in which.

SPECIFIC DESCRIPTION

Figure 1:
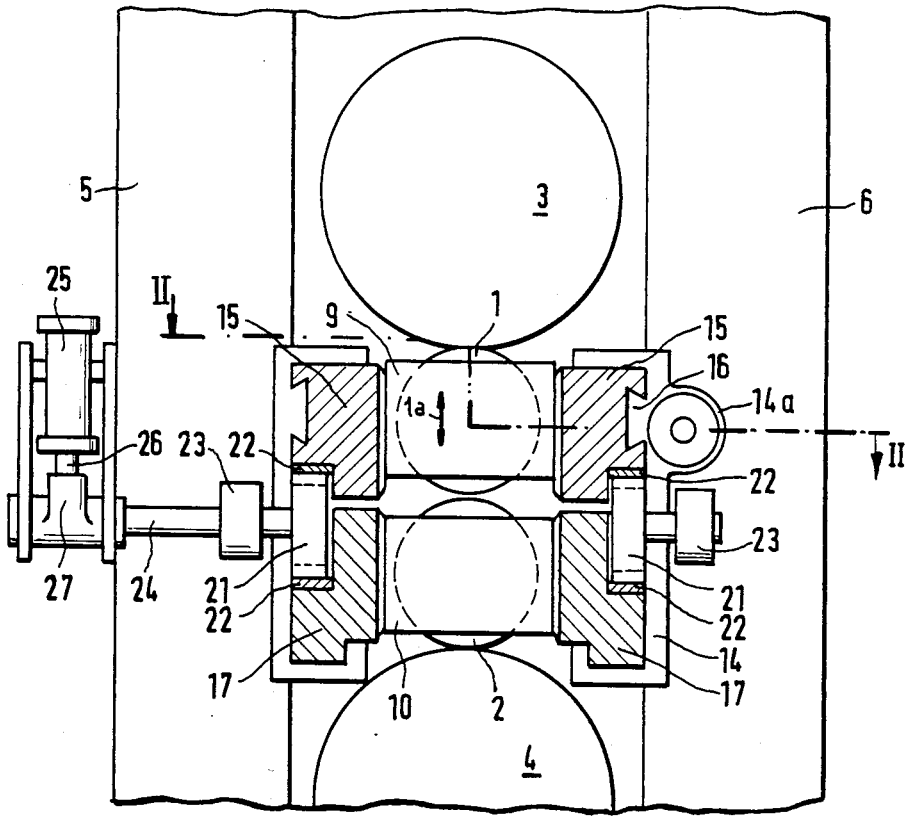
FIG. 1 is a vertical section through a four-high roll stand according to the invention looking inward from the service side and showing the pushers in section and with different actuating arrangements on the right and left sides.
Figures 2A, 2B:
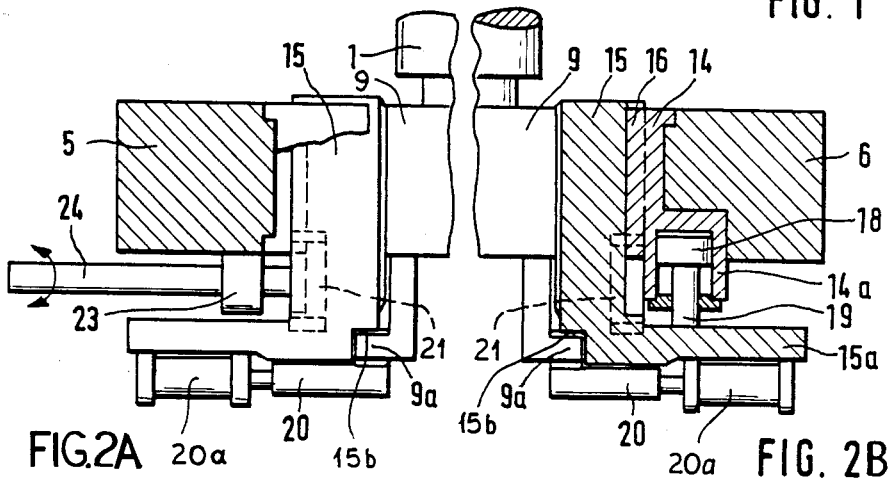
FIG. 2A is a horizontal section taken along offset plane II—II of FIG. 1 and showing the left side of the equipment.
FIG. 2B is a view like FIG. 2A but showing the right-side of a variant on the system of FIG. 2A.
Figure 5:
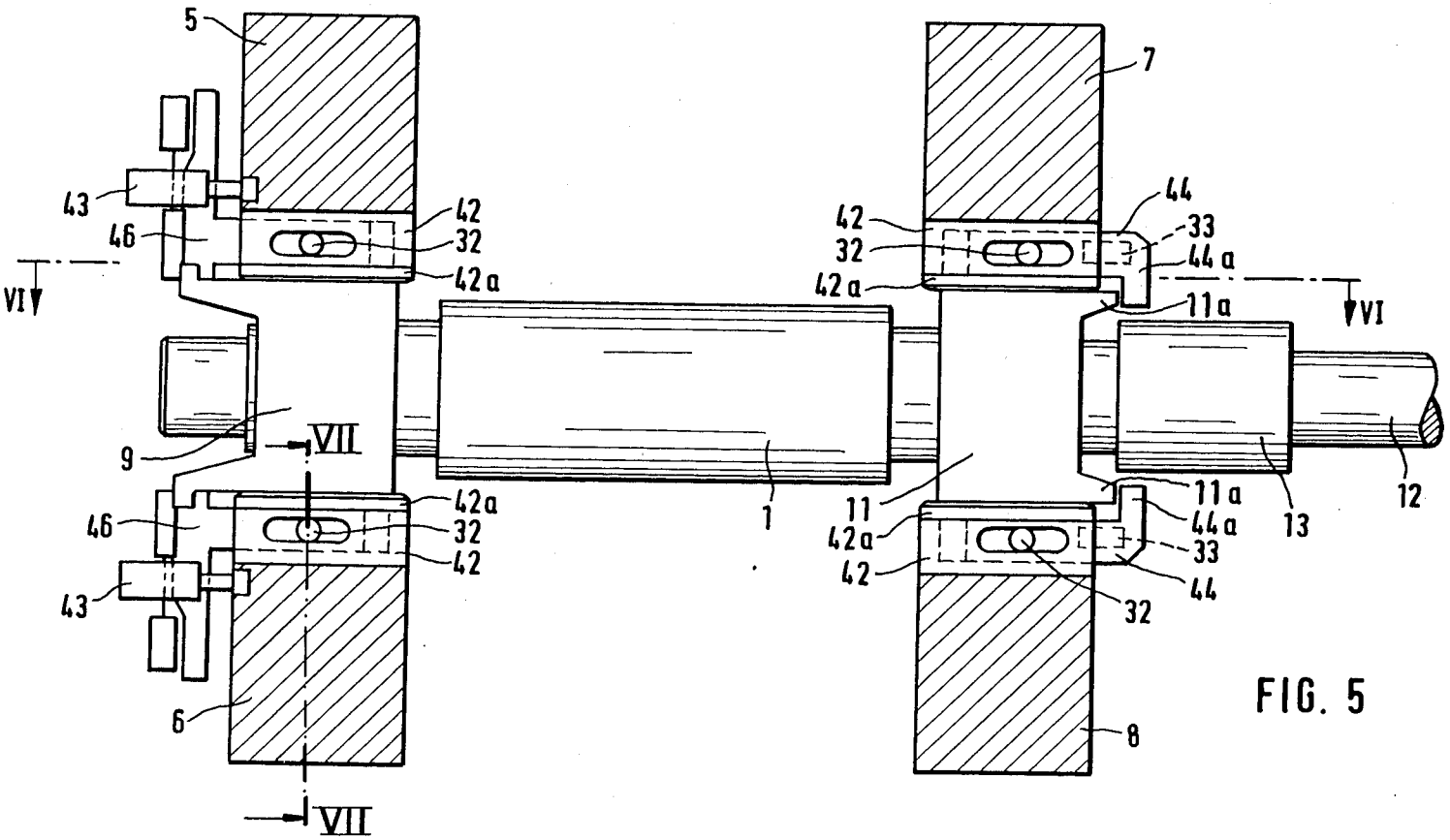
FIG. 5 is a horizontal section through another arrangement that is provided with roll benders.

As seen in FIGS. 1, 2A, and 2B and most of the other figures of the drawing the four-high roll stand according to this invention has a frame 5, 6, 7, 8 formed by service-side posts or uprights 5 and 6 and drive-side posts or uprights 7 and 8. Small diameter working rolls 1 and 2 are supported on the service side in journal blocks 9 and 10 and on the drive side in blocks 11 (FIG. 5 only) between large-diameter backup rolls 3 and 4, all of the rolls 1 through 4 being rotatable about respective parallel axes lying generally in a common vertical plane. FIG. 5 shows how the roll 1 is provided with a coupling 13 on the drive side connected to a main drive shaft 12, the roll 2 being similarly driven to move a strip workpiece perpendicular to the roll-axes plane through the nip formed between the rolls 1 and 2.

As best in FIGS. 1, 2A, and 2B for the blocks 9 and 10 the posts 5 and 6 are provided with guides 14 that support via axially extending dovetail formations 16 respective pusher bodies 15 and 17 that support the blocks 9 and 10 and are axially coupled thereto by tab formations **9*a*. The bodies 15 and 17 are formed with vertically extending grooves 15*b* into which these tabs 9*a* engage and the other blocks 11 are identically supported. These tabs 9*a* can be uncoupled by withdrawal of a removable locking slide 20 mounted on the pusher-body extension 15*a* and of the type described in above-cited German patent document No. 3,331,055 to which reference can be made for further details of how the blocks 9, 10, and 11 are coupled for joint axial but independent vertical movement with the respective pusher bodies 15 and 17**.

According to this invention the bottom of each upper pusher body 15 and the confronting top part of each lower body 17 is formed with a rack 22 and a common pinion gear 21 mounted in a bearing 23 fixed in the respective post 5 or 6 meshes with both of these racks 22. As a result axial displacement of either of the bodies 15 or 17 in either direction will cause axially opposite and complementary movement of the other body in the opposite direction.

Such axial movement can be effected by bracing a double-acting cylinder 14*a* having a piston 18 with a piston rod 19 between the post 6 and the extension 15*a* of the body 15 as shown in FIG. 2B, or by coupling the gear 21 to a drive shaft 24 as shown in FIGS. 1 and 2A. This shaft 24 is provided with an arm 25 connected to the rod 26 of a double-acting ram 25 as shown in FIG. 1. The use of such a cylinder 25 as shown in FIGS. 1 and 2A only allows relatively limited axial movement of the rolls 1 and 2. Thus this arrangement is only of particular use when the rollers are of bottle or barrel shape or for use with cylindrical rolls when the variations in workpiece width are minor.

Figure 3:
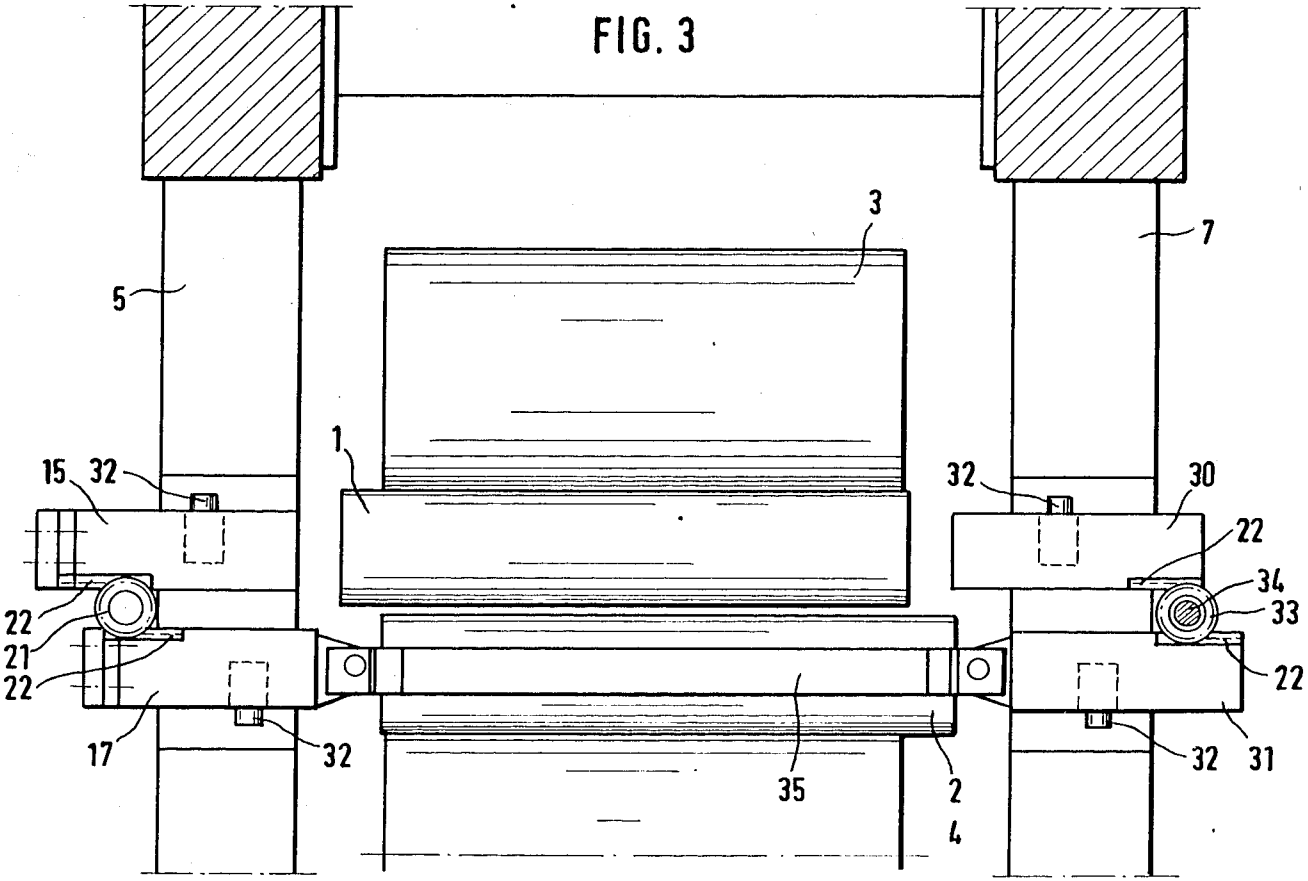
FIG. 3 is an end view of a system equipped with benders for synchronizing axial shifting of both pusher bodies of both working rolls.
Figure 7:
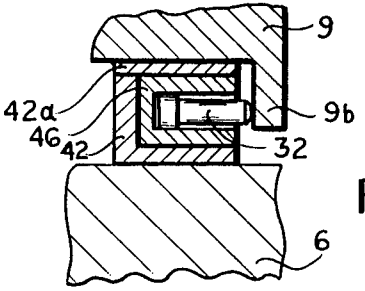

While in the arrangements of FIGS. 1, 2A, and 2B the drive-side blocks of the working rolls 1 and 2 are only connected via the respective journal blocks 11 and working rolls 1 and 2 to the service-side pusher blocks 15 and 17, in FIG. 3 a rigid tie bar 35 is provided which extends between the lower service-side pusher 17 and the lower drive-side pusher 31 of the same roll 2. In addition this pusher 31 is connected to the respective upper pusher 30 by a further pinion 33 like the pinion 21 and meshing with racks 22 on the pushers 30 and 31. This synchronizing pinion 33 is carried on a shaft 34 that extends to the other drive-side pusher blocks which also have a gear 21 and racks 22. FIG. 3 also shows diametrically oppositely working push rods 32 of bending devices that engage the respective journal blocks via respective claws shown at 9*b* in FIG. 7. In this arrangement the axial opposite shifting of the service-side pushers 30 and 31 is effective via the tie bar 35 and the pinions 33 to cause the pusher bodies 15 and 17 of the drive side follow, that is travel axially synchronously therewith.

Figure 4A:
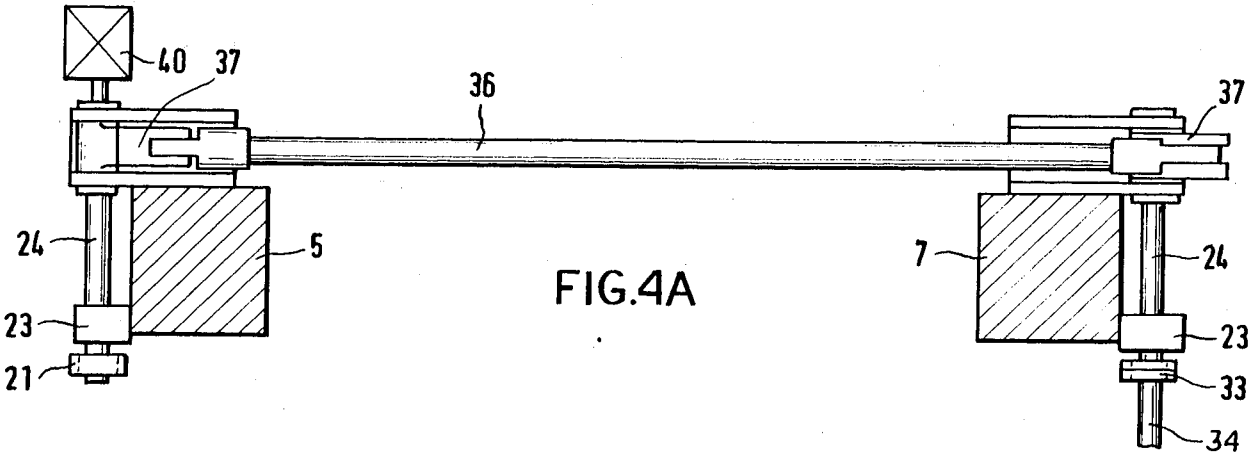
FIGS. 4A and 4B are horizontal sections schematically illustrating other systems for synchronizing displacement of the pusher bodies.
Figure 4B:
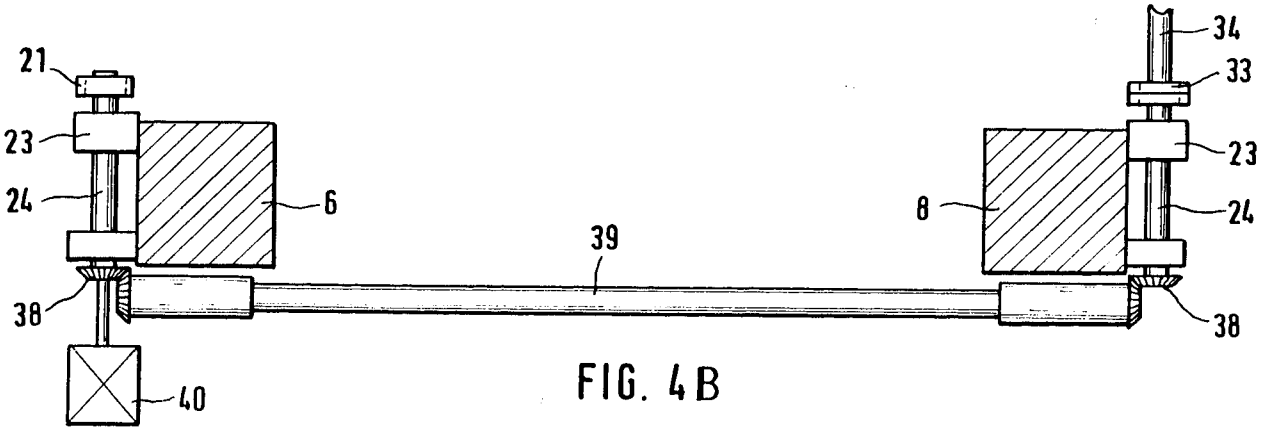

In FIG. 4A the two shafts 24 on opposite sides are provided with arms 37 that are parallel and have outer ends connected to a link 36 that replaces the link 35. This link 36 therefore acts like part of a parallelogrammatic linkage to oscillate the two shafts 24 synchronously from the drive 40. FIG. 4B shows how the shaft 34 can have at its end a bevel gear 38 meshing with a bevel-gear shaft 39 whose opposite end meshes with another such gear 38 on the service-side drive shaft 24 driven by the axial-shift drive 40.

Figure 6:
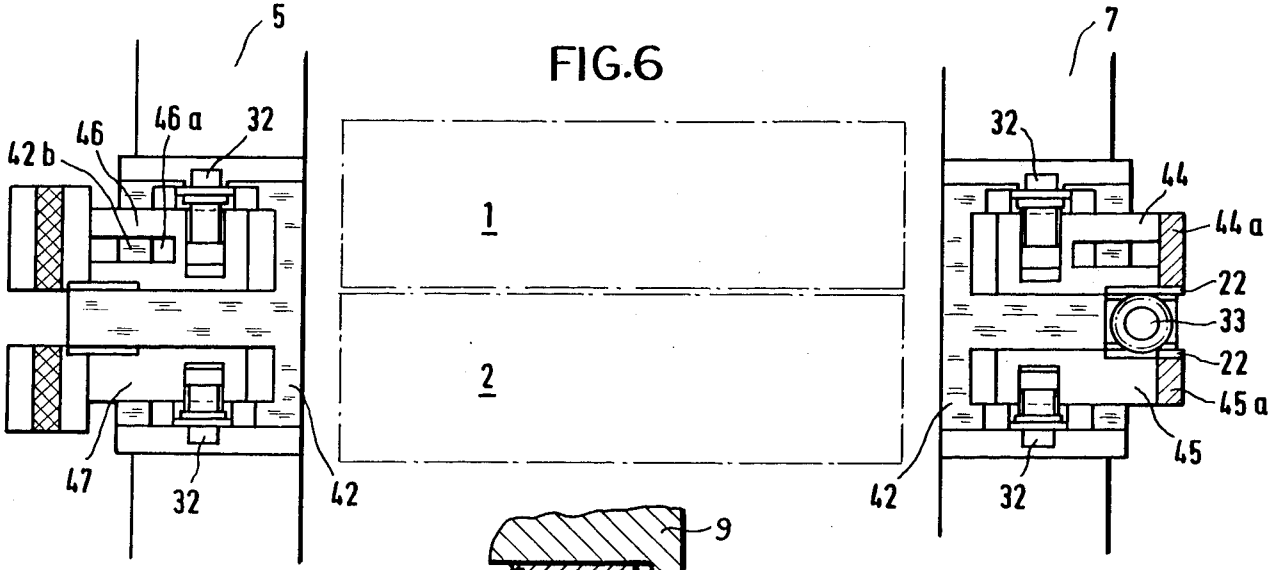
FIGS. 6 and 7 are sections taken respectively along lines VI—VI and VII—VII of FIG. 5.

The arrangement of FIGS. 5 and 6 does not differ markedly from the embodiment on the right in FIG. 2, something that requires that the pushers 46 and 47 be coupled with the service-side journal block 9 of the upper working roll 1 so as to allow relative vertical movement of the block 9 and the roll 1. The main difference is that both pushers 46 and 47 do not directly form the upright guide surfaces for the journal blocks, but these guides are formed by removable cover plates 42*a* of fixed elements 42 in which the bending rods 32 are mounted. In addition external double-acting cylinders 43 are provided for axially shifting the block 9.

The drive-side pushers 44 and 45 have inwardly extending abutments 44*a* and 45*a* which engage abutments 11*a* of the drive-side journal block 11. Thus when the journal block 11 of the upper working roll 1 is shifted inward or toward the right as seen in the drawing from the service side, the upper pair of pusher bodies 44 are entrained. As a result of the synchronicity created by the drive-side pinions 33 the lower pair of pushers 45 are oppositely displaced and displace via the abutments 45*a* the lower journal block with the lower working roll 2. On axial shifting of the upper working roll toward the left the unillustrated synchronizing pinion 21 effects on the service side an opposite shifting of the lower pusher body 45 and a shifting of the lower working roll 2 toward the right via the connection with the journal block 10. In addition the lower drive-side journal block 11 entrains via the abutments 11*a* the lower pusher 45 so that the drive-side pinion 33 pushes the upper pusher 44 and the upper journal block 11 to the left, the abutments 11*a* and 44*a* always remaining in contact although the connection only works for pushing. Since the working rolls 1 and 2 are held at both ends, it is advisable to leave some play in the gears 21, 22, and 33 to compensate for thermal expansion and contraction.

As seen on the left of FIG. 6 the square-section pushers 46 have outwardly open recesses 46*a* in which engage projections 42*b* of the blocks 42. These projections 42*b* extend transversely right to the cover 42*a* and serve to stiffen the block 42 in order to avoid that the movability of the pusher body 46 is impeded by wedging in its guide.

Thus the service-side pinion is not necessary when, with force-transmitting abutment connections on the drive side, for each working roll there is on the service side a respective single-acting actuator or a pair of actuators that are alternately operated. This solution has some advantages from the control point of view as dimensional changes caused by thermal expansion and contraction become irrelevant. As one working roll is pushed one way, the mechanical connections will automatically push the opposite one in the opposite direction, and length changes are compensated for by the hydraulic medium.

We claim:

1. A roll stand comprising:

a stationary frame having a drive side and a service side;

upper and lower working rolls having axially opposite ends at the sides;

respective pairs of upper and lower journal blocks coupled with the ends of the rolls at the sides for rotation in the frame about respective parallel upper and lower axes;

drive means connected to the working-roll ends at the drive side for oppositely rotating the working rolls about their respective axes;

respective upper and lower pusher bodies adjacent the journal blocks in the frame;

respective upper and lower guides in the frame supporting the bodies for displacement of same only axially in the frame;

respective pairs of formations at least one of which is vertically elongated coupling each of the bodies to the respective block for joint axial displacement while permitting relative vertical nonaxial displacement between the bodies and the respective blocks;

means directly engaging at least one of the pusher bodies for axially shifting same and the respective journal block and roll in the frame;

respective substantially identical, axially extending, and confronting racks formed on the upper pusher body of the service side and on the respective lower pusher body;

a service-side gear meshing with both of the racks; and means supporting the gear on the frame for rotation on the service side about a stationary axis perpendicular to the racks and nonmovable on the frame, whereby axial displacement of one of rolls with the respective rack rotates the gear and axially oppositely displaces the other working roll regardless of the relative vertical positions of the rolls.

2. The roll stand defined in claim 1 wherein the axial shifting means is a reversible drive motor connected directly to the one gear.

3. The roll stand defined in claim 1, further comprising:

means including benders braced against the journal blocks for bending the working rolls.

4. The roll stand defined in claim 2, further comprising:

respective axially extending and confronting drive-side racks formed on at least one of the upper pusher bodies of the drive side and on the respective lower pusher body;

a gear meshing with both of the drive-side racks; and means supporting the gear on the frame for rotation on the drive side about a stationary axis perpendicular to the drive-side racks.

5. The roll stand defined in claim 4, further comprising link means between the service- and drive-side pusher blocks for jointly and synchronously axially displacing same.

6. The roll stand defined in claim 5 wherein the link means includes a rigid axially extending link extending between a one of the service-side pusher bodies and the corresponding drive-side pusher body.

7. The roll stand defined in claim 4, further comprising link means including a coupling shaft connected between the service- and drive-side gears for jointly and synchronously rotating same.

8. The roll stand defined in claim 7 wherein the link means includes:

service- and drive-side gear shafts carrying the respective gears; and respective arms projecting generally parallel to each other from the gear shafts, the coupling shaft being connected between the arms like parallelogrammatic linkage.

9. The roll stand defined in claim 7 wherein the link means includes:

service- and drive-side gear shafts carrying the respective gears;

bevel gears mounted on the gear shafts; and bevel gears in mesh with the gear-shaft bevel gears and carried on the coupling shaft.

10. The roll stand defined in claim 9 wherein the axial shifting means is a reversible drive motor connected directly to the service-side gear shaft.

11. The roll stand defined in claim 1 wherein each pusher body has a nonaxially projecting abutment constituting the respective formation and the respective journal block also has such a vertically extending groove receiving the respective abutment and constituting the respective formation.

12. The roll stand defined in claim 1 wherein the axial-shifting means includes respective upper and lower single-acting actuators connected to the upper and lower pusher bodies.

13. The roll stand defined in claim 1 wherein the guides are open toward the journal blocks and provided with covers, the pusher bodies having outwardly open recesses, the journal blocks being provided with projections engaging through the guides to the covers.

* * * * *